US006089729A

United States Patent [19]

Chang

[11] Patent Number: 6,089,729

[45] Date of Patent: Jul. 18, 2000

[54] RATCHET SCREWDRIVER WITH ILLUMINATION FUNCTION

[76] Inventor: Chen-Chi Chang, No. 69, Chang-I 5th Street, Tai-Ping City, Taichung Hsien, Taiwan

[21] Appl. No.: 09/274,876

[22] Filed: Mar. 23, 1999

[51] Int. Cl.[7] ..... B25B 23/18

[52] U.S. Cl. ..... 362/120; 362/578

[58] Field of Search ..... 362/119, 120, 362/578

[56] References Cited

U.S. PATENT DOCUMENTS 2,225,405 12/1940 Ostermann ..... 362/578 X 5,713,656 2/1998 Lin ..... 362/120

5,971,560 10/1999 Chen ..... 362/119

*Primary Examiner*—Stephen Husar

*Attorney, Agent, or Firm*—Rosenberg, Klein & Lee

[57] ABSTRACT

A ratchet screwdriver with illumination function, including a hollow main body in which an illumination device is disposed. A front end of the main body is fixedly connected with a transparent housing in which a ratchet sleeve is installed. By using a non-circular hole which has a shape for complementarily engaging with a ratchet seat, the ratchet seat is closer to the illumination device. Accordingly, when the light projected from the illumination device is focused at the front end of the sleeve, the base seat will not block the light and in use of the ratchet screwdriver, an illumination function can be achieved.

9 Claims, 5 Drawing Sheets

RATCHET SCREWDRIVER WITH ILLUMINATION FUNCTION

BACKGROUND OF THE INVENTION

The present invention relates to a ratchet screwdriver with illumination function, in which an illumination device is installed in a main body of the ratchet screwdriver.

FIG. 4 shows an existing screwdriver 90. When it is necessary to illuminate a working side, an illumination device 80 can be fitted onto the stem 91 of the screwdriver 90. The illumination device 80 includes a housing 81 in which a switch 82, a cell (not shown) and a light emitting diode 83 are disposed. A clamping section 84 is disposed at front end of the illumination device 80. The clamping section 84 is formed with outer thread 85 and a fissure 86 at front end. A sleeve 87 formed with inner thread 88 is screwed with the outer thread 85 of the clamping section 84, making the clamping section 84 tightly clamp the stem 91 of the screwdriver 90.

The illumination device 80 is fitted on the stem 91 of the screwdriver 90 without any protection. Therefore, during working, the illumination device 80 is subject to collision of alien article and is apt to damage or fail. FIG. 5 shows another type of existing ratchet screwdriver in which a ratchet mechanism 60 is installed on a grip 70. The ratchet mechanism 60 includes a base seat 61 on which a sleeve 62, a ratchet 63, a stopper plate 64 and a switch 65 are mounted. A casing 68 is fitted around the base seat 61. The casing 68 is formed with a slot 69 through which the switch 65 protrudes. An engaging section 66 extends from a rear end of the base seat 61. The engaging section 66 is formed with multiple projections 67. The engaging section 66 and the projections 67 are engaged into a socket 71 of the grip 70 so as to connect the ratchet mechanism 60 with the grip 70.

The sleeve 62 has a relatively large diameter so that the aforesaid illumination device 80 cannot be fitted therewith. In case a light emitter is disposed in the grip, the excessively long distance between the base seat 61 and the light emitter will result in that when the light is projected from the light emitter and focused at the front end of the sleeve, the light will be shaded by the base seat 61. Therefore, the front end of the sleeve 62 will be a dead corner of the projected light and the illumination effect will be greatly reduced. In case the engaging section 66 is omitted, the ratchet mechanism 60 will be unable to be coupled with the grip 70.

SUMMARY OF THE INVENTION

It is therefore a primary object of the present invention to provide a ratchet screwdriver with illumination function. By means of a non-circular hole which has a shape for complementarily engaging with a ratchet seat, the ratchet seat is closer to the illumination device. When the light is projected from an illumination device and focused at the front end of the sleeve, the light will not be shaded (or blocked) and in use of the ratchet screwdriver, a good illumination function can be achieved.

According to the above object, the ratchet screwdriver of the present invention includes a hollow main body in which an illumination device is disposed. One end of the main body is connected with a transparent housing. A resilient push bottom is disposed at a center of the other end of the main body. By means of pressing the resilient push button, the resilient push button is able to turn on a push switch. A ratchet tool is disposed on an outer end of the main body. The transparent housing includes a non-circular hole having a shape for complementarily engaging with a ratchet seat so as to make the ratchet seat can be inserted and be secured without any rotation. An outer surface of the housing can be fit with a transparent inner cap. Whereby the base seat is closer to the illumination device. Accordingly, when the light projected from the illumination device is focused at the front end of the sleeve, the base seat will not block the light. A resilient push button is disposed at a rear end of the main body. By means of pressing the push button, the pressing switch of the illumination device can be touched to control the illumination function of the ratchet screwdriver. The present invention can be best understood through the following description and accompanying drawings, wherein:

DETAILED DESCRIPTION OF THE PREFERRED EMBODIMENT

Figure 1:
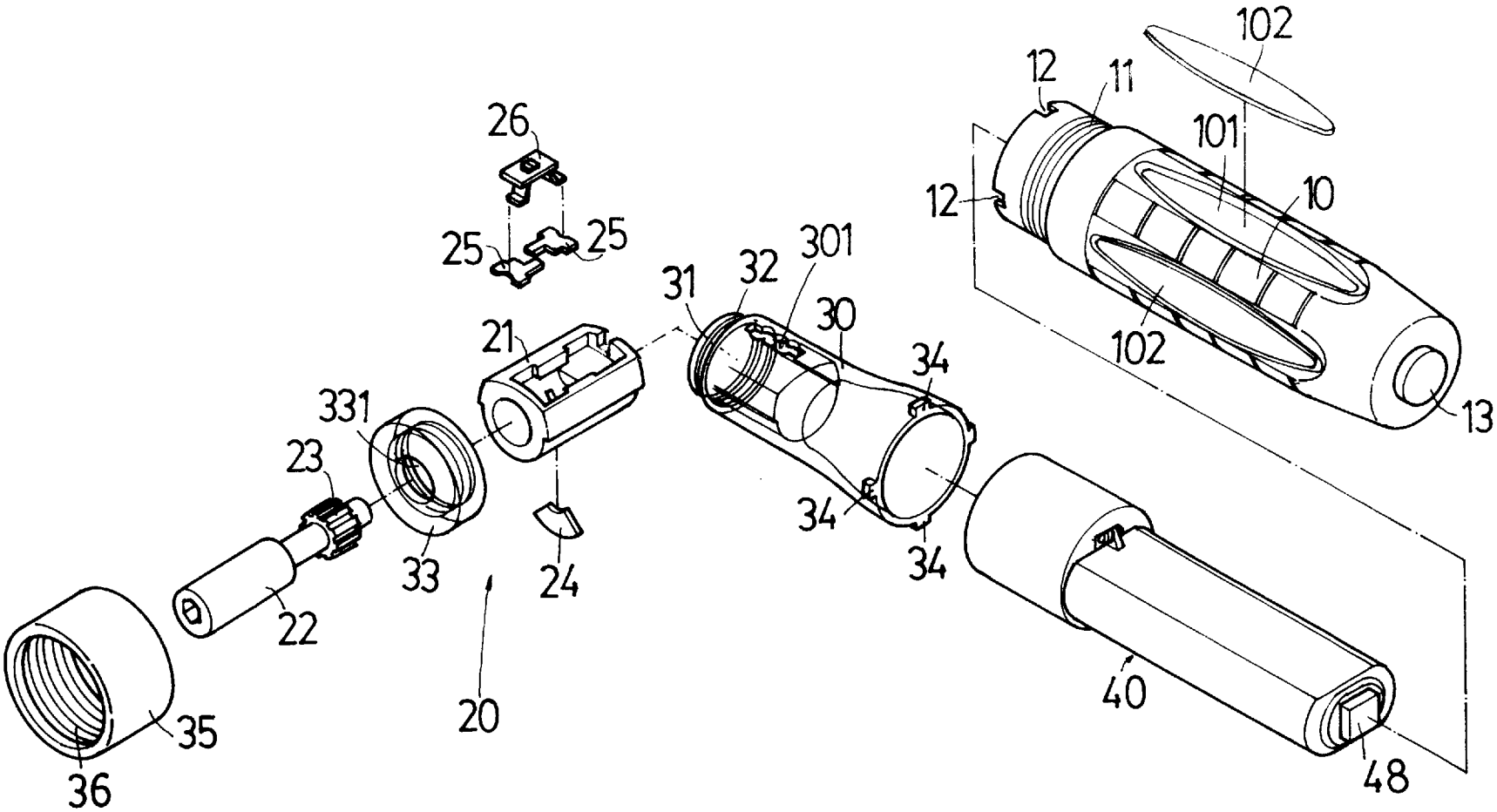
FIG. 1 is a perspective exploded view of the present invention.
Figure 2:
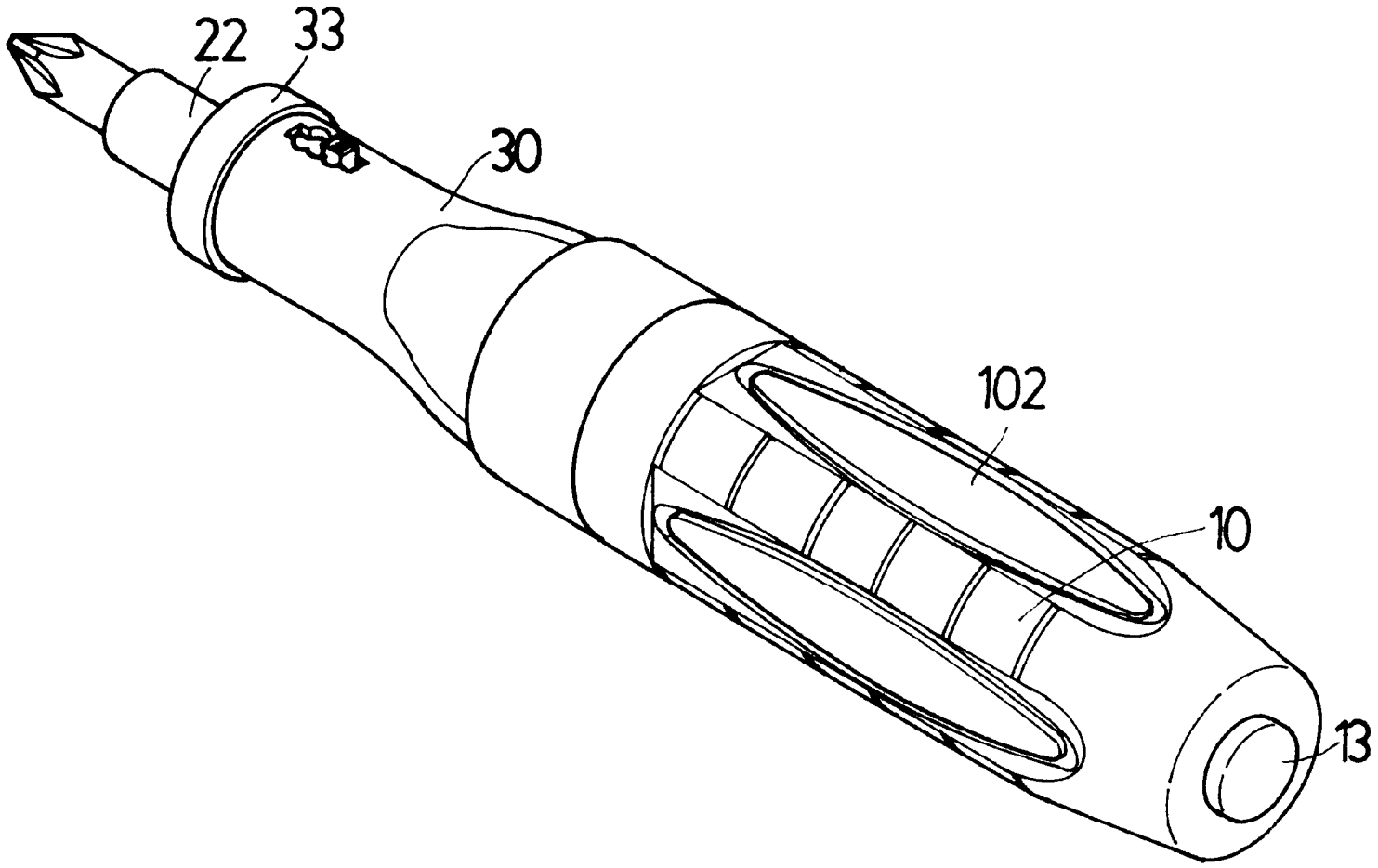
FIG. 2 is a perspective assembled view of the present invention.
Figure 3:
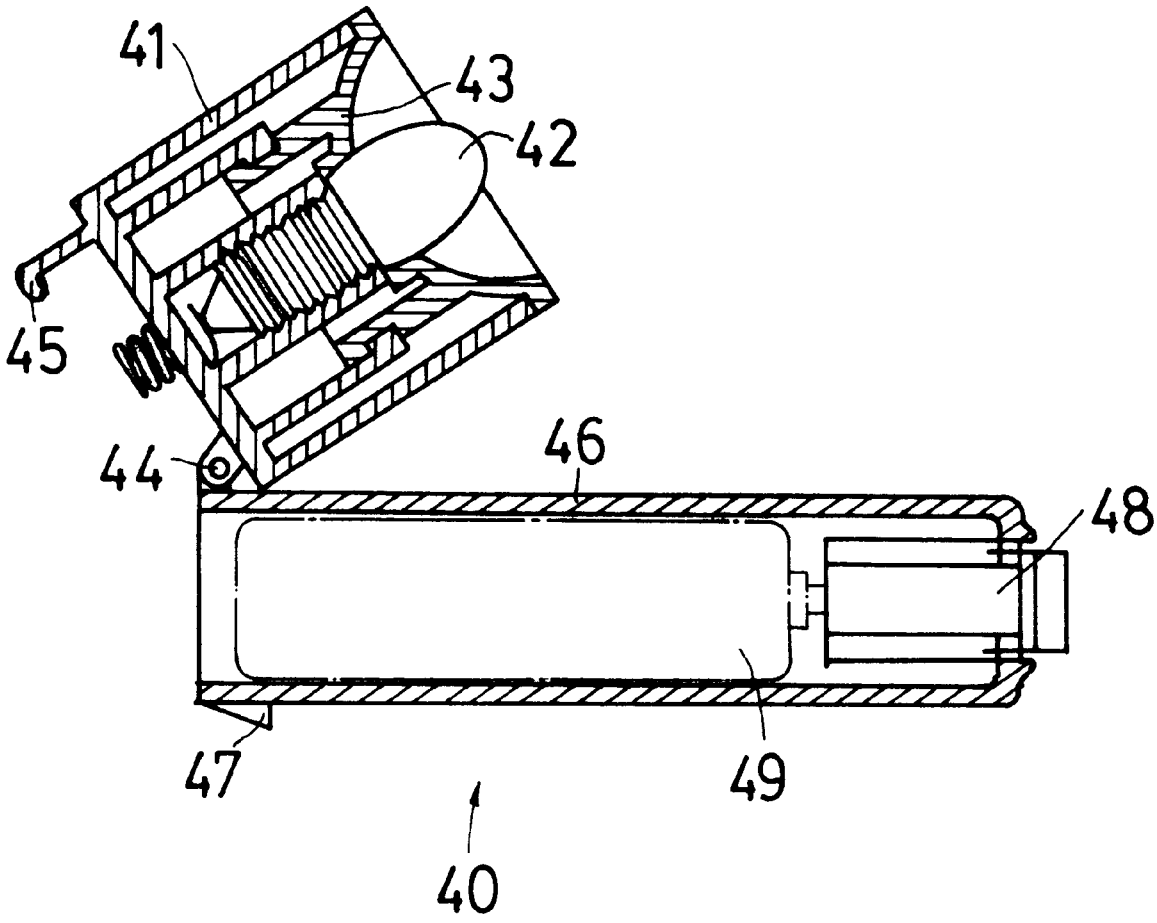
FIG. 3 is a sectional view of the illumination device of the present invention.
Figure 4:
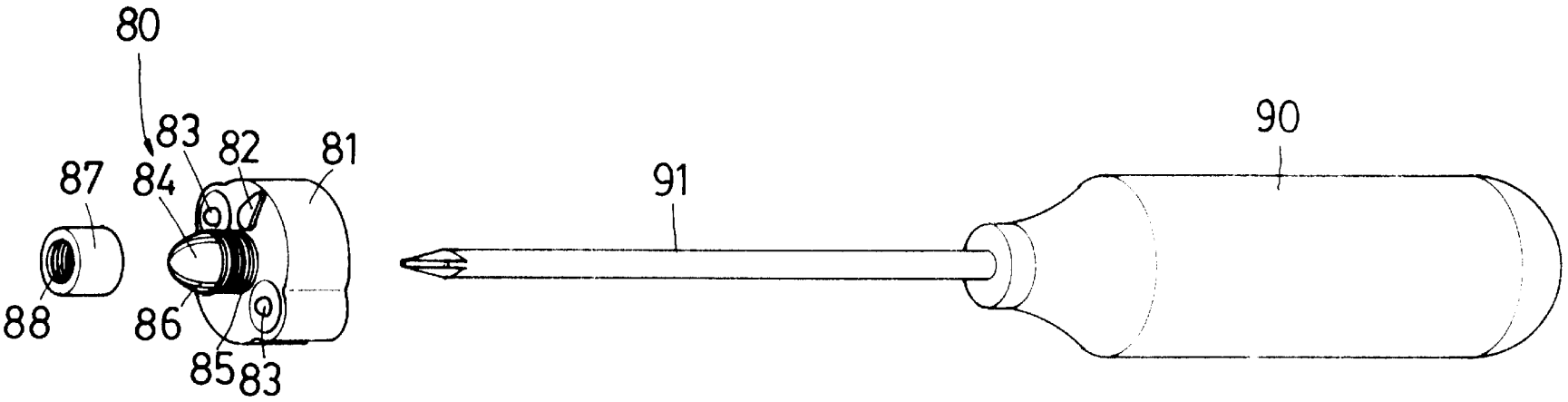
PRIOR ART FIG. 4
FIG. 4 is a perspective exploded view of a conventional screwdriver with illumination device.
Figure 5:
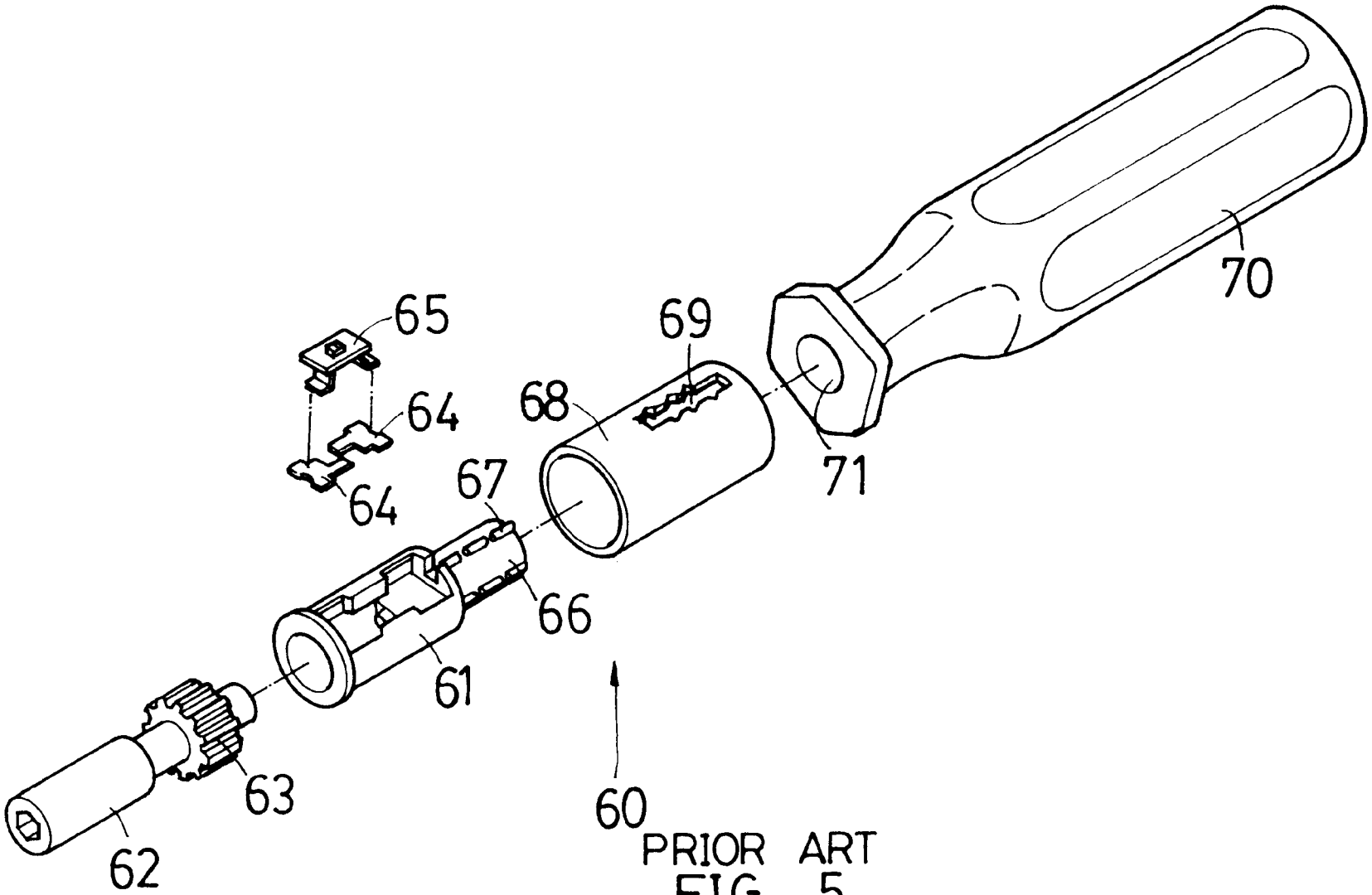
PRIOR ART FIG. 5
FIG. 5 is a perspective exploded view of a conventional ratchet screwdriver.

Please refer to FIGS. 1 to 3. The ratchet screwdriver of the present invention includes:

- a hollow main body 10, said main body 10 having a plurality of recesses 101 for adhering several anti-slip adhesive plates 102 therein, one end of the main body 10 being formed with an outer thread section 11, a periphery of a front end of the outer thread section 11 being formed with over one notch 12, a center of the other end of the main body 10 being disposed with a resilient push button 13;
- a ratchet tool 20 is disposed with a sleeve 22 inside the ratchet seat 21, one end of the sleeve 22 is disposed with a ratchet 23 inside the ratchet seat 21, an engaging plate 24 is disposed beneath the ratchet seat 21 for limiting said ratchet 23 within the ratchet seat 21, said ratchet seat 21 further includes at least one stopper plate 25 and a switch 26, so that the rotating direction of the ratchet 23 of the ratchet tool 20 can be changed by moving the switch 26 and its stopper plate 25;
- a transparent housing 30, the transparent housing 30 including a central non-circular hole 31 having a shape for complementarily engaging with a ratchet seat 21, its outer periphery having a thread portion 32, so it makes the ratchet seat 21 can be inserted and be secured by the non-circular hole 31 without any rotation, also, the switch 26 of the ratchet tool 20 being protruded out via an slot 301 of the housing 30, and then a transparent inner cap 33 can be fit with the thread portion 32, the sleeve 22 of the ratchet tool 20 being protruded through a hole 331 of the inner cap 33 so that the ratchet seat 21 can be secured inside the housing 30 by the inner cap 33, a periphery of one end of the transparent housing 30 has at least one protruded flange 34 for engaging with the notch 12 of the main body 10, said housing having an outer cap 35, the outer cap 35 with an inner thread 36 for engaging with an outer thread section 11 of the main body 10 so that the housing 30 can be secured on the main body 10; and an illumination device 40 including a bulb seat 41 in which a bulb 42 and a light shade 43 are disposed. One end of the bulb seat 41 is symmetrically disposed with a pivot section 44 and a latch hook 45 opposite to the light shade 43. The pivot section 44 is pivotally connected with a battery box 46. One end of the battery box 46 pivotally connected with the bulb seat 41 is disposed with a projecting section 47 corresponding to the latch hook 45 of the bulb seat 41 for latching with the latch hook 45. The other end thereof is disposed with a pressing switch 48. A battery 49 is installed in the battery box 46. The illumination device 40 is received in the main body 10 with one end of the light shade 43 facing the housing 30. When pressing the push button 13 of the main body 10, the pressing switch 48 of the illumination device 40 is touched.

By means of the non-circular hole 31 which has a shape for complementarily engaging with a ratchet seat 21, the ratchet seat 21 will not rotate. In addition, the inner cap 33 makes the ratchet seat 21 secured inside the housing 30 and let the base seat 21 be closer to the bulb 42 of the illumination device 40. Accordingly, when the light shade 43 of the illumination device 40 focuses the projected light at the front end of the sleeve 22, the ratchet seat 21 will not block the light. Therefore, in use of the ratchet screwdriver, an excellent illumination function can be achieved.

It is to be understood that the above description and drawings are only used for illustrating one embodiment of the present invention, not intended to limit the scope thereof. Any variation and derivation from the above description and drawings should be included in the scope of the present invention.

What is claimed is:

1. A ratchet screwdriver with illumination function, comprising a hollow main body, an illumination device being disposed in said main body, one end of the main body being connected with a transparent housing, a resilient push button being disposed at a center of the other end of the main body, by means of pressing the resilient push button, said resilient push button being able to turn on a push switch, a ratchet tool being disposed on a first end of the transparent housing, said transparent housing including a non-circular hole having a shape for complementarily engaging with a ratchet seat, said ratchet seat being inserted and secured within said transparent housing without any rotation, an outer surface of the transparent housing being fit with a transparent inner cap for securing said ratchet seat inside the housing so that the illumination device can provide a light for the ratchet tool during a working time.

2. A ratchet screwdriver with illumination function as claimed in claim 1, wherein an outer thread section is disposed on said one end of said main body, and at least one notch is disposed on a periphery of a front edge of the outer thread section, a periphery of a second end of the transparent housing has at least one protruded flange for engaging with the notch of the main body, said transparent housing has an outer cap, said outer cap having an inner thread for engaging with said outer thread section of the main body so that the transparent housing can be secured on the main body.

3. A ratchet screwdriver with illumination function as claimed in claim 1, wherein said illumination device includes a bulb seat in which a bulb and a light shade are disposed, one end of the bulb seat being symmetrically disposed with a pivot section and a latch hook opposite to the light shade, the pivot section being pivotally connected with a battery box, one end of the battery box pivotally connected with the bulb seat and being disposed with a projecting section corresponding to the latch hook of the bulb seat for latching with the latch hook, the other end thereof being disposed with the pressing switch, a battery being installed in the battery box, the illumination device being received in the main body, whereby by means of pressing the push button of the main body, the pressing switch of the illumination device is touched.

4. A ratchet screwdriver with illumination function as claimed in claim 1, wherein said ratchet tool is disposed with a sleeve inside the ratchet seat, one end of the sleeve is disposed with a ratchet inside the ratchet seat, an engaging plate is disposed beneath the ratchet seat for limiting said ratchet within the ratchet seat, said ratchet seat further includes at least one stopper plate and a switch, so that the rotating direction of the ratchet of the ratchet tool can be changed by moving the switch and its stopper plate.

5. A ratchet screwdriver with illumination function, comprising a hollow main body, an illumination device being disposed in said main body, one end of the main body being connected with a transparent housing, a ratchet tool being disposed on a first end of the transparent housing, said transparent housing including a non-circular hole having a shape complementary to a ratchet seat for engagement of said ratchet seat without any rotation, an outer surface of the transparent housing being fit with a transparent inner cap for securing said ratchet seat inside the transparent housing so that the illumination device can provide a light for the ratchet tool during a working time.

6. A ratchet screwdriver with illumination function as claimed in claim 5, wherein an outer thread section is disposed on said one end of said main body, and at least one notch is disposed on a periphery of a front edge of the outer thread section, a periphery of a second end of the transparent housing has at least one protruded flange for engaging with the notch of the main body, said transparent housing having an outer cap, said outer cap having an inner thread for engaging with said outer thread section of the main body so that the transparent housing can be secured on the main body.

7. A ratchet screwdriver with illumination function as claimed in claim 5, wherein said illumination device includes a bulb seat in which a bulb and a light shade are disposed, one end of the bulb seat being symmetrically disposed with a pivot section and a latch hook opposite to the light shade, the pivot section being pivotally connected with a battery box, one end of the battery box being pivotally connected with the bulb seat and being disposed with a projecting section corresponding to the latch hook of the bulb seat for latching with the latch hook, the other end thereof being disposed with the pressing switch, a battery being installed in the battery box, the illumination device being received in the main body, whereby by means of pressing the push button of the main body, the pressing switch of the illumination device is touched.

8. A ratchet screwdriver with illumination function as claimed in claim 5, wherein said ratchet tool is disposed with a sleeve inside the ratchet seat, one end of the sleeve is disposed with a ratchet inside the ratchet seat, an engaging plate is disposed beneath the ratchet seat for limiting said ratchet within the ratchet seat, said ratchet seat further includes at least one stopper plate and a switch, so that the rotating direction of the ratchet of the ratchet tool can be changed by moving the switch and its stopper plate.

9. A ratchet screwdriver with illumination function as claimed in claim 5, wherein a resilient push button is disposed at a center of the other end of the main body, wherein pressing the resilient push button turns on a push switch.

* * * * *